United States Patent [19]

Vorus et al.

[11] Patent Number: 4,789,306

[45] Date of Patent: Dec. 6, 1988

[54] MARINE PROPELLER

[75] Inventors: William S. Vorus, Gregory; Robert F. Kress, Grand Rapids, both of Mich.

[73] Assignee: Attwood Corporation, Lowell, Mich.

[21] Appl. No.: 72,721

[22] Filed: Jul. 13, 1987

Related U.S. Application Data

[63] Continuation-in-part of Ser. No. 798,540, Nov. 15, 1985, abandoned.

[51] Int. Cl.[4] ..... B63H 1/18

[52] U.S. Cl. ..... 416/223 R; 416/234; 416/237; 416/243

[58] Field of Search ..... 416/223 R, 223 A, 228, 416/234, 235, 236 R, 236 A, 237, 242, 243, 175 R

[56] References Cited

U.S. PATENT DOCUMENTS

| | | | |
|---|---|---|---|
| D. 138,866 | 9/1944 | Orsett . | |
| 283,592 | 8/1883 | Fulmer | 416/237 |
| 329,822 | 11/1885 | De Bruignac | 416/237 |
| 411,802 | 10/1889 | Freed | 416/237 |
| 746,007 | 12/1903 | Bruncker | 416/237 |
| 794,010 | 7/1905 | Hayden | 416/237 |
| 978,677 | 12/1910 | Taylor | 416/236 |
| 1,041,912 | 10/1912 | Tyson | 416/237 |
| 1,688,639 | 10/1928 | Larson | 416/237 |
| 1,872,749 | 8/1932 | Karageorge | 416/223 |
| 1,895,252 | 1/1933 | Kontos | 416/223 R |
| 2,327,453 | 8/1943 | Presser | 416/62 |
| 2,421,798 | 6/1947 | Marshall | 416/237 |
| 2,582,107 | 1/1952 | Dakin | 416/237 |
| 3,065,723 | 11/1962 | Tulin | 114/274 |
| 3,077,173 | 2/1963 | Lang | 114/278 |
| 3,306,246 | 2/1967 | Reder | 114/280 |
| 3,572,962 | 3/1971 | Embleton et al. | 415/119 |
| 4,073,601 | 2/1978 | Kress | 416/242 |
| 4,293,280 | 10/1981 | Yim | 416/236 A |

FOREIGN PATENT DOCUMENTS

| | | | |
|---|---|---|---|
| 2314862 | 6/1976 | France . | |
| 127581 | 8/1920 | United Kingdom | 416/237 |

OTHER PUBLICATIONS

Minutes of Meeting of Panel H-8, *Society of Naval Architects and Marine Engineers*, Bethesda, Md., Jan. 14, 1985.

Photograph, Propeller Design, Hatteras Yachts, 1986.

"Performance Data of Propellers for High-Speed Craft" by R. N. Newton and H. P. Rader, *The Royal Institution of Naval Architects*, quarterly transactions, Apr. 1961, vol. 103, No. 2.

"Supercavitating and Superventilated Propellers", by Roderick A. Barr, presented at the Annual Meeting, New York, N.Y., Nov. 12–13, 1970, *The Society of Naval Architects and Marine Engineers*, pp. 417–443.

"A Rational Approach to Propeller Geometry", No. 11, by J. Lester Klein, *The Society of Naval Architects and Marine Engineers*, paper presented at Propellers 75, Philadelphia, Pa., Jul. 22–23, 1975. 1975.

"RMI and Ingalls Select Lips Propellers for U.S. Navy Vessels", from *Lips Service* (a newsletter by Lips Propellers), fall, 1985.

*Primary Examiner*—Robert E. Garrett

*Assistant Examiner*—Joseph M. Pitko

*Attorney, Agent, or Firm*—Price, Heneveld, Cooper, DeWitt & Litton

[57] ABSTRACT

A multi-bladed marine propeller designed for efficient operation in intermediate, partially cavitating flow regions between fully cavitating flow and noncavitating flow. Each of the blades has a radially inner subcavitating section and an outer section which is configured to have a higher angle of attack and tapered trailing and leading edges so that it supercavitates at high speeds either with or without ventilation and subcavitates at low speeds. Various other features of each blade include different length chords on the pressure and suction sides of the outer section and an inclined trailing surface area extending between the chord ends for improved off design, design point, and astern operation. A minimized transition area is included between the inner and outer sections, and narrow chord lengths are provided in the tip area to minimize and balance overall tip section drag. The supercavitating outer section also has positive rake to improve ventilation performance and positive skew to minimize undesirable transition flow. The result is a propeller with improved efficiency at low speeds without degrading the supercavitating section performance at high speed.

44 Claims, 7 Drawing Sheets

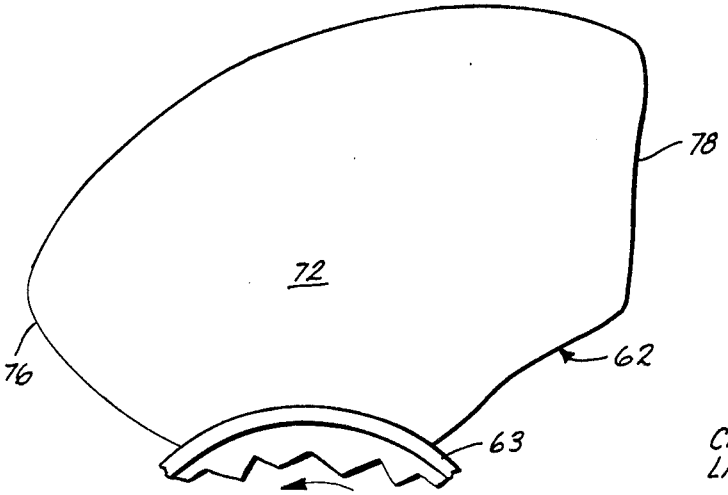
Fig. 10
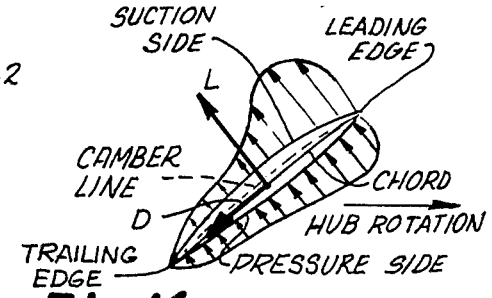
Fig. 16.
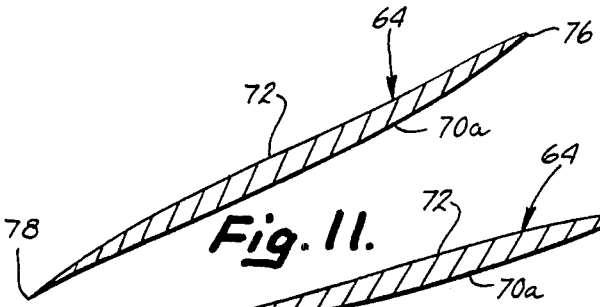
Fig. 11.
Fig. 12.
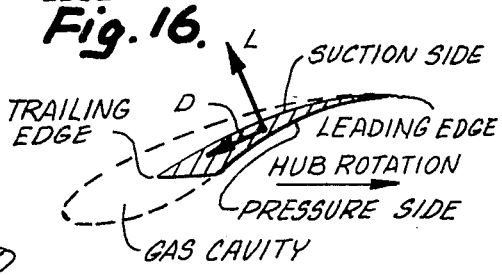
Fig. 17.
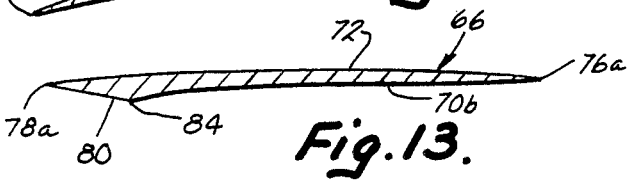
Fig. 13.
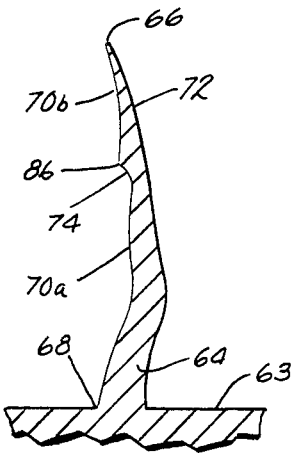
Fig. 14.
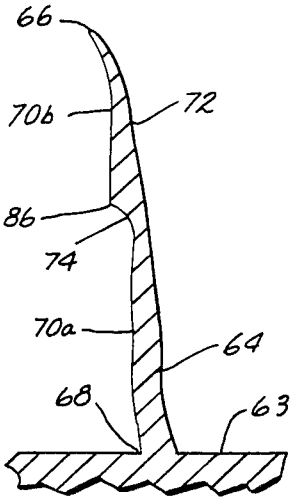
Fig. 15.

MARINE PROPELLER

CROSS-REFERENCE TO RELATED APPLICATION

This application is a continuation-in-part of co-pending U.S. patent application Ser. No. 06/798,540, filed Nov. 15, 1985 by William S. Vorus entitled "MARINE PROPELLER" now abandoned.

BACKGROUND OF THE INVENTION

This invention relates generally to marine propellers and, more particularly, to an improved marine propeller which includes a hybrid blade configuration providing improved performance at a design point between fully subcavitating and fully supercavitating flow conditions.

Cavitation is an operational characteristic of marine propellers and results when marine propeller blades are rotated at a sufficiently high speed and loading to develop very low pressures along the curved suction side or back of each blade. When the pressures are sufficiently small, a vacuum tends to develop in the low pressure area. The result is that water flowing along the blade back is unable to follow the exact contour of the blade section creating an opening or cavity along the blade back. When such cavities are fully developed in the chord-wise direction and extend beyond the trailing edge of the blade sections, they are known as supercavities and the blade section is operating in supercavitation. Cavitation can only occur in a liquid such as water but not in a gas such as air. The pressure within the cavitation cavities is generally very near the vapor pressure of the liquid.

Ventilation is another operational characteristic of marine propellers in which the cavity pressure is atmospheric. Here the rotating blades either pierce the surface of the water or come so close to the surface that the air is drawn downwardly through the blade tip vortices. This allows atmospheric air to reach the blade through the water opening.

When a marine propeller blade supercavitates below the water surface, the blade is enveloped in a gas cavity containing water vapor at a defined vapor pressure. However, when a supercavitating marine propeller blade operates while ventilating at or near the surface, the gas cavity is at atmospheric pressure.

FIG. 36 in the drawings illustrates the typical operating regimes or flow regions for marine propellers. Conventional marine propeller blade design procedures have been applied to blades which operate totally in the noncavitating region, i.e., low speed at a given thrust, or totally in the fully cavitating region, i.e., high speed at a given thrust, either with or without ventilation. While either design approach or procedure results in propeller designs which operate efficiently at their respective supercavitating or noncavitating design points, such design procedures would suffer from significant inefficiencies when applied to applications where the design point fell within the partially cavitating region of FIG. 36.

In U.S. Pat. No. 4,293,280, a propeller concept is disclosed which attempts to overcome certain problems previously experienced with marine propellers. The concept of U.S. Pat. No. 4,293,280 discloses propeller blades capable of efficient operation at intermediate speed ranges where partial cavitation conditions exist as shown in FIG. 36. Each blade in the propeller of U.S. Pat. No. 4,293,280 includes a radially outer portion with a different blade shape than the radially inner portion so that the outer blade portion has a blunt trailing and a tapered leading edge and a higher blade angle of attack than the inner blade portion. The result is a marine propeller which, in concept, will operate efficiently in coexisting supercavitating and subcavitating flow regions such as the partially cavitating region of FIG. 36.

However, the marine propeller of U.S. Pat. No. 4,293,280 fails to address many practical problems encountered both at the design point and at off design conditions.

SUMMARY OF THE INVENTION

Accordingly, the present invention provides a marine propeller including a hub and multiple blades. Each blade is a hybrid which is adapted to operate efficiently in the partially cavitating region as shown in FIG. 36 between noncavitating and fully supercavitating operation. The present marine propeller blades are hybrid blades wherein the radially inner portion of the blade is noncavitating and the radially outer portion is supercavitating. Thus, the concept of the present invention provides a blade especially adapted for use in the central region of FIG. 36.

In one aspect, the improved propeller of this invention includes a plurality of blades on a hub, each blade having an inner subcavitating section in addition to an outer section which supercavitates at high speeds but also subcavitates at low speeds. This results in a propeller with improved efficiency at low speeds by allowing both sections of each propeller blade to subcavitate while not degrading the performance of the supercavitating section at high speeds.

In addition, the blade chord length in the outer section of the propeller blade of this invention is narrowed to minimize tip section drag of the blade thereby improving propeller efficiency. Under supercavitating operation, the drag on the outer, hybrid section consists of a viscous drag occurring on the face of the blade section and a cavity drag on the back of the blade section. By narrowing the chord length, both face and back areas of the outer section are reduced to thereby reduce net viscous and cavity drag on the blade.

In the interest of minimizing the radial transition from sub-to-supercavitating flow, the lift coefficient must be elevated rapidly across the transition region between subcavitating flow and supercavitating flow. In the blade of this invention, this is accomplished with a rapid chord reduction in the transition region along with a significant increase in the face pitch. The transition region between subcavitating and supercavitating flow is minimized to reduce the excessive drag and inefficiency that is associated with partial section cavitation. Partial section cavitation is also highly unstable and can lead to local blade erosion as well as vibration and noise. In one aspect of the present invention this minimization is accomplished by forming the blade with transition regions which are smoothly contoured on the pressure and suction sides, sometimes called the face and back sides, so as to eliminate abrupt structure discontinuities which may produce flow separation with resulting low pressure and undesirable bubble cavitation.

In other aspects of the invention, the hybrid outer section of the blade is provided with a high tip sweep angle to minimize the extent of the undesirable transition flow. The tip sweep induces radially outward flow components over the tip which tend to deflect the supercavity on the suction side outward away from the subcavitating inner blade region. By inhibiting the inward drift of the supercavity, a clean distinct division across the transition region is achieved.

The supercavity generated off the back of the blade of this invention is clean and stable due to relatively high lift coefficient. As the viscous drag of the non-cavitating pressure face is directly proportional to section chord length, stable, supercavitating section performance is also achieved with minimum overall section drag with the narrow chord length. Stated otherwise, the reduced area in the outer section of the propeller blade of this invention provides for a stable supercavity on the suction side of the propeller blade and the viscous drag force on the propeller blade is reduced. The result is a blade that operates under stable conditions with improved efficiency.

In other aspects of the invention, the outer blade section on each blade of the propeller is uniquely contoured to have different face and back chords, i.e., differential pressure side and suction side chord lengths, in order to control cavity drag and reduce viscous drag without affecting the overall blade outline. With this aspect of the invention, the outer section includes a convex suction side and a concave pressure side on opposite sides of the blade, the suction side having a chord length greater than the chord length of the pressure side generally at each radial position along the outer section. Further, a trailing surface area extends between the trailing ends of the chords on the pressure side and on the suction side. The longer suction side or back chord promotes subcavitation when conditions permit without inhibiting supercavitation performance at higher speeds. In addition, this configuration of the outer section promotes improved astern performance as well.

In yet other aspects of the invention, a transition zone extends between the inner and outer blade sections and includes an offset on the pressure side of the outer section while the suction side is clean and smooth over its entire extent from the root adjacent the hub to the outer section tip. Also, the outer section of each blade on the present marine propeller extends at a positive rake angle which, in the preferred embodiment, increases progressively in a direction toward the outer tip. The increasing, nonlinear tip rake of the outer blade portions shield the tip of the blade pressure side from the surface of the water, especially when the propeller is trimmed. Thus, when an outboard engine or stern drive is trimmed by upward rotation such that it more directly faces the water surface, the front of the boat is raised to reduce water resistance and increase speed. The positive rake in the present invention prevents premature blowout or extreme ventilation of the blade to maintain proper thrust when the propeller is so trimmed. This allows a greater degree of propeller trim and higher boat speeds with the present invention.

In addition, each blade preferably includes a negative skew angle in the inner section which changes to a positive skew angle in the outer supercavitating section. This helps limit partial cavitation in the transition area.

It is also possible to vary the blades of the present invention within prescribed limits to emphasize operation of the inner or outer sections as desired. Thus, either a low cavity drag or a low viscous drag hybrid blade may be provided within the scope of this invention. The low cavity drag blade has a transition zone closer to the outer tip and reduced pressure drag due to reduced cavity size from the outer section. The low viscous drag blade has a transition zone closer to the root section of the blade, and lower viscous drag on the inner section.

The result of these features is a marine propeller which will operate more efficiently over a range of speeds with reduced craft vibration and noise and can be used over a prolonged service life because of reduced wear due to cavitation erosion of the propeller surfaces.

Further objects, features and advantages of the invention will become apparent from a consideration of the following description and the appended claims when taken in conjunction with the following drawings.

BRIEF DESCRIPTION OF THE DRAWINGS

FIG. 10 is an enlarged front elevation of the suction side of the blade of FIG. 9 showing the front profile of the blade projected parallel to the rotational axis of the propeller hub;

FIG. 11 is a sectional view at about 0.36 of the radius of the blade as taken along line XI—XI of FIG. 9;

FIG. 12 is a sectional view at about 0.40 of the radius of the blade as taken along line XII—XII of FIG. 9;

FIG. 13 is a sectional view at about 0.87 of the radius of the blade as taken along line XIII—XIII of FIG. 9;

FIG. 14 is a sectional view taken along the zero degree radius or blade center line XIV—XIV of FIG. 9;

FIG. 15 is a sectional view taken along a radial line XV—XV which is spaced 20 degrees rearwardly from the blade center line or radius XIV—XIV in FIG. 9;

FIG. 16 is a schematic diagram of the typical lift profile showing the resultant forces acting on a typical subcavitating hydrofoil similar to that included in the inner sections of the blades of the present invention;

FIG. 17 is a schematic diagram of the vapor cavity resulting from supercavitating high speed operation of the outer blade section of the present invention;

DESCRIPTION OF THE PREFERRED EMBODIMENTS

Figure 1:
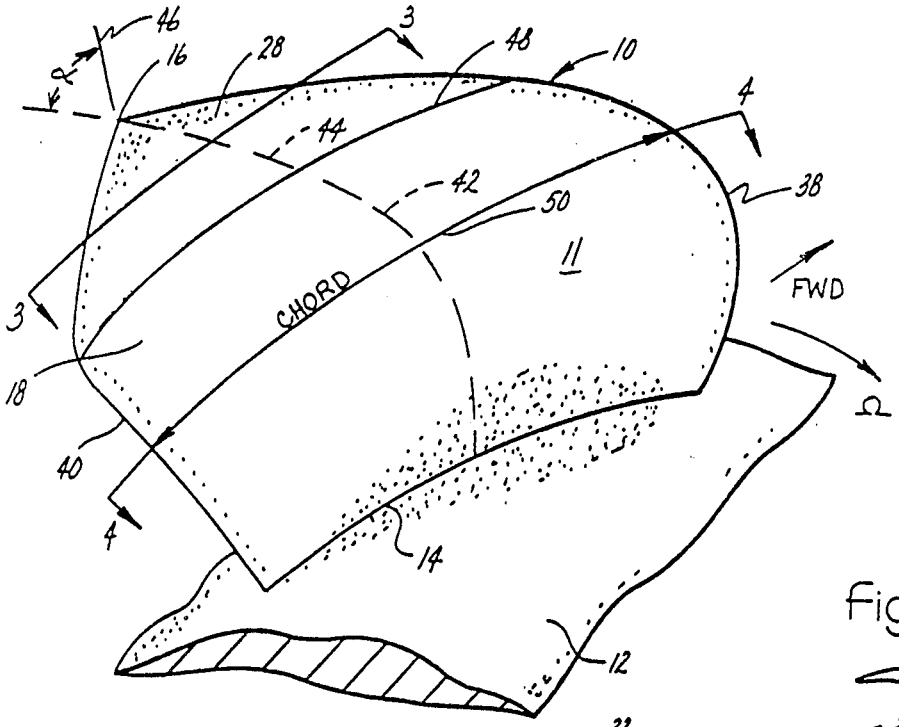
FIG. 1 is an elevational view of a first embodiment of the improved propeller blade of this invention, showing the face or pressure side of the blade and illustrating the blade mounted on a hub, only a fragmentary portion of which is shown.
Figure 6:
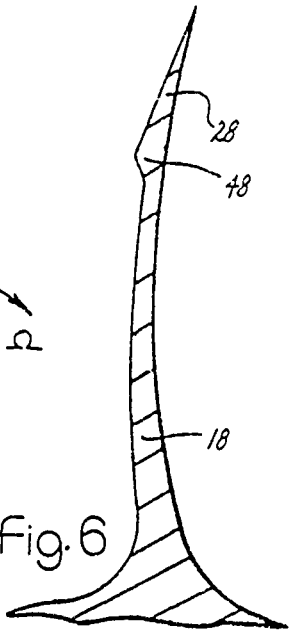
FIGS. 5 and 6 are longitudinal sectional views of spaced portions of the propeller of FIGS. 1 and 2 as seen from substantially the lines 5—5 and 6—6 in FIG. 2.

With reference to the drawings, a first embodiment of the propeller blade of this invention, indicated generally at 10, is shown in FIG. 1 mounted on a hub 12 which always carries a plurality of blades 10 to form a complete propeller. The propeller 10 consists of a body 11 having a radially inner end or root 14 adapted to be located adjacent hub 12 and a radially outer pointed tip 16 which is located radially outwardly from the hub.

Each blade body 11 has a radially inner section 18 located adjacent the inner end 14 and extending outwardly therefrom which is contoured so that it has a rounded leading edge 20 and a tapered trailing edge portion 22, with arcuate suction and pressure side surfaces 24 and 26, respectively, extending therebetween.

Figure 4:
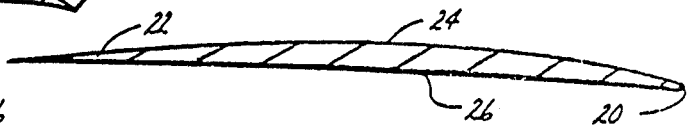
FIGS. 3 and 4 are sectional views along the chord lines of the propeller blade of FIGS. 1 and 2, as seen substantially from the lines 3—3 and 4—4 in FIG. 1.
Figure 3:
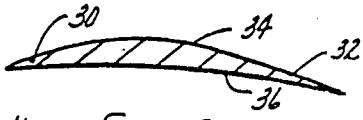

Blade body 11 also has an outer section 28, generally smaller in area than inner section 18, which is located adjacent tip 16 and extends radially inwardly therefrom. Section 28 is contoured so that it has a tapered trailing and leading edge portions 30 and 32, respectively, with arcuate suction and pressure side surfaces 34 and 36, respectively, extending therebetween. The side surfaces of outer section 28 are arched on a smaller radius than the inner section so as to give the outer section a higher face camber than the inner section, as shown in FIGS. 3 and 4.

Figure 2:
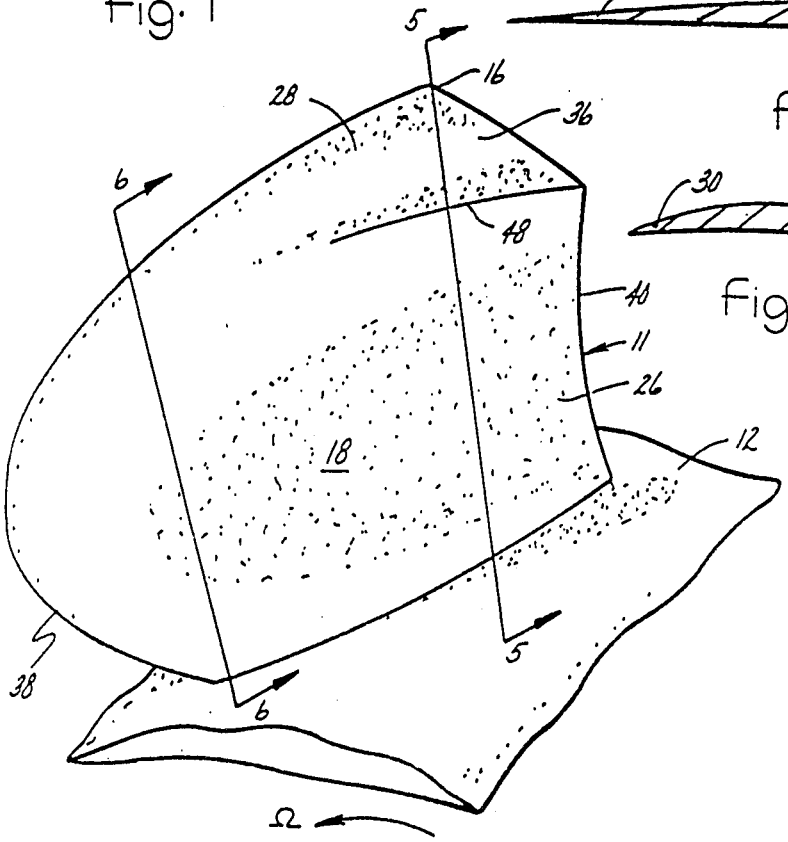
FIG. 2 is an elevational view of the first embodiment of the propeller blade of FIG. 1, showing the back or suction side of the blade.

During rotation of blade 10 through the water the relatively sharp edge 38 functions as the leading edge and the similarly sharp edge 40 functions as the trailing edge, the direction of blade rotation being shown by arrows in FIGS. 1 and 2, so that the propeller will tend to move hub 12 in the forward direction indicated by the arrows in FIGS. 1 and 2. Propeller 10 is proportioned and structured so that during rotation of blade 10 at high speeds, inner section 18 functions in a noncavitation producing manner and outer section 28 functions in a supercavitation producing manner, producing a large vapor or gas bubble which envelopes the tip suction surface 34 and trails rearwardly from the trailing edge portion 30 in a manner as explained below in connection with FIG. 17. For that reason, sections 18 and 28 are sometimes referred to herein as noncavitating and supercavitating sections. At low speeds, both sections function in a noncavitation producing manner and for that reason, section 28 is sometimes referred to herein as a hybrid section.

Figure 5:
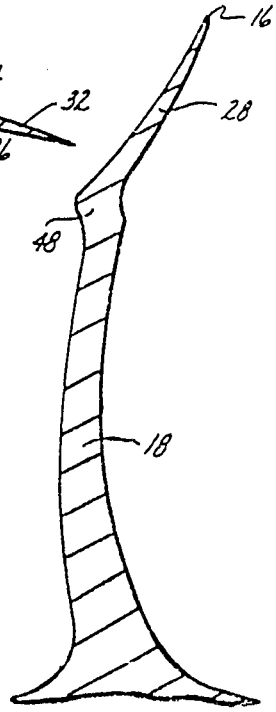
Figure 7:
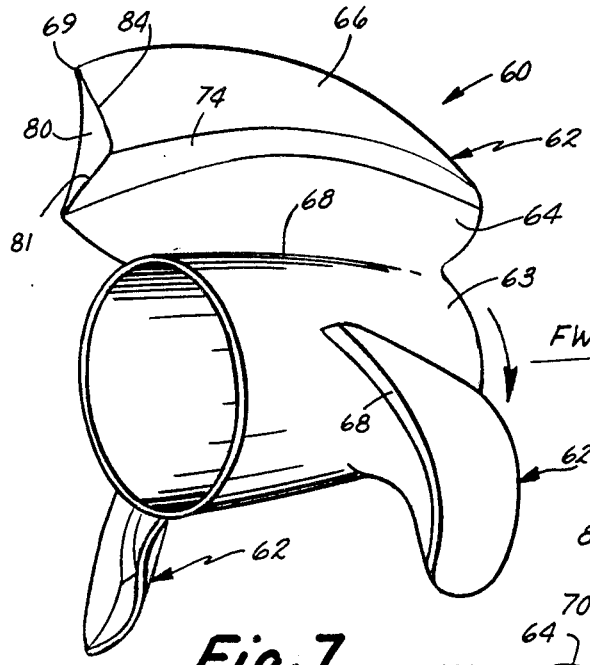
FIG. 7 is a perspective view of a second embodiment of the marine propeller of the present invention comprising a low cavity drag propeller.

As shown in FIG. 1, a mid-chord line 42 extending through tip 16 has its radially outer portion 44 located in outer section 28 and inclined downwardly and rearwardly through tip 16 at an angle $\alpha$ to radial line 46 through tip 16. As shown in FIG. 1, angle $\alpha$ is greater than 45 degrees which demonstrates that tip section 28 of propeller 10 is swept rearwardly at a significant angle. As disclosed in FIGS. 1, 2, 5 and 6 and as will be explained below in connection with FIG. 27, blade section 28 includes both positive rake and positive skew of the outer blade section 28 as described in terms of accepted propeller blade geometry. As a result, tip 16 is located much closer to trailing edge 40 than it is to leading edge 38. This swept back shape of blade 10 induces radially outward flow components over tip 16 which tend to deflect the supercavity on suction side 34 outward away from subcavitating inner blade section 18. By inhibiting any inward drift of the supercavity, a clean distinct division across transition region 48 of blade 10 is achieved. As shown in FIGS. 4 and 5, in the transition region 48, blade body 11 is of increased thickness which aids structural strength. Also as shown in FIGS. 1–6, transition region 48 of blade 10 is smoothly contoured on both the pressure and suction sides so as to eliminate abrupt structural discontinuities which may produce undesirable flow separation and undesirable bubble cavitation.

The result is a marine propeller with blades 10 that will operate more efficiently over a range of speeds with reduced craft vibration and noise and can be used over a prolonged service life because of reduced wear due to cavitational erosion of propeller surfaces. As shown in FIG. 1, the chord length of blade 10 in section 18 which has the longest chord lengths, indicated at 50, is much longer than the chord lengths in section 28 to assure operation of section 18 at subcavitating conditions and enable operation of section 28 at supercavitating conditions. The cross-sectional shape of section 28 with high face camber shown in FIG. 3 results in the radial sectional shape shown in FIG. 5 near the trailing edge of blade 10 in which blade section 28 is at an angle to section 18. It also results in chord 50 being substantially longer than mid-chord line 42 between inner end 14 of propeller 10 and tip 16 in the illustrated embodiment of blade 10. However, it is within the purview of the invention to construct blade 10 without this particular dimensional relationship, i.e., high chord/mid-chord line ratio.

Also, transition region 48 is of minimum size and outer section 28 is of somewhat triangular shape and is of significantly smaller chord than the subcavitation section 11. This reduced chord in hybrid section 28 provides for a stable supercavity on rear or suction face 3 and the drag force on propeller blade 10 is reduced. This construction promotes operation of the propeller blade under stable cavitating conditions with improved efficiency.

Tapered sections 30 and 32 of hybrid section 28 enable section 28 to operate at slow speeds as a noncavitating section while not degrading the performance of section 28 at supercavitating higher speeds.

Referring now to FIGS. 7–15, a second embodiment 60 of the marine propeller is shown. Like embodiment 10, propeller 60 is preferably made from traditional metals such as bronze or aluminum alloys, or stainless steel as well as synthetic, composite or other materials. Propeller 60 includes a hub 63 which is preferably cylindrical but could be slightly tapered in either a converging or diverging manner having multiple blades 62, preferably three. The arrows in FIGS. 7–10 illustrate normal rotation of the propeller to produce forward thrust from the blades. As with propeller 10, each blade 62 of propeller 60 includes an inner, subcavitating blade section 64 and an outer, supercavitating blade section 66. The inner end or root 68 of inner section 64 on each blade is integrally joined to hub 63 at an angle to the rotational axis of the hub. Each blade is contoured to include a generally aft or rearward facing, generally concave surface or pressure side 70 (FIGS. 7–9) and a generally forward facing, generally convex or suction side 72 (FIG. 10). On the face or pressure side 70 of each blade, the pressure side surface **70*a* of inner section 64 is offset with respect to the pressure side surface 70*b* of the outer section 66 by means of a curved transition zone or area 74 which extends in an arc generally parallel to the circumference of hub 63 from the leading edge 76 of blade 62 to the trailing edge 78. In addition, each outer blade section 66 includes a trailing surface area 80** which promotes improved design and off design performance including astern or reverse operation.

Figure 30:
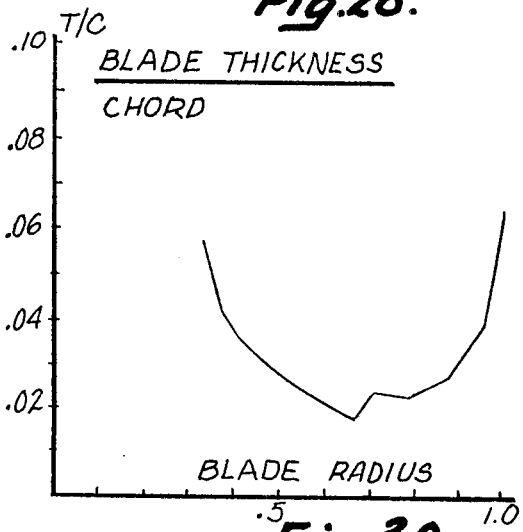
FIG. 30 is a graph of the blade thickness to chord ratio versus blade radius for the propeller blades of FIGS. 7–15.

With reference to FIGS. 9–13, each of the inner sections 64 includes a varying subcavitating or lower speed hydrofoil shape which is adapted from NACA series airfoil sections for use with marine propellers. Inner section 64 also includes a generally convex suction side surface or back 72 and a pressure side or face 70 which varies from slightly concave to slightly convex along a blade radius progressing outwardly through the inner section. In addition, the chord lengths increase from root 68 outwardly toward the transition zone or area 74 while the leading edge 76 is rounded and trailing edge 78 of each section is tapered (FIGS. 11 and 12). In the preferred embodiment, transition zone 74 is positioned at approximately two-thirds of the total blade radius providing an inner section area on both the pressure and suction sides which is larger than the corresponding areas of the outer section 66. The progressively increasing chord lengths of the inner section provide proper blade performance as the velocity of the blade sections increase progressively outwardly along the radius of the blade. As illustrated in FIGS. 11, 12, 14 and 15, the thickness of the inner section increases from the rounded leading edge 76 to its thickest portion approximately one-half of the way along the blade chord and then gradually tapers or thins to the tapered trailing edge 78. However, in the radial direction, the thickness of blade section 64 decreases from root 68 to transition area 74 as shown in FIG. 30. As shown schematically in FIG. 16, inner blade section 64 produces lift L in a direction perpendicular to the in-flow velocity which is parallel to blade pitch. Lift L is due to the differential in the negative pressure on the back or suction side and the positive pressure from the face or pressure side. Drag D is produced by the combination of skin friction drag on the suction and pressure sides.

Figure 27:
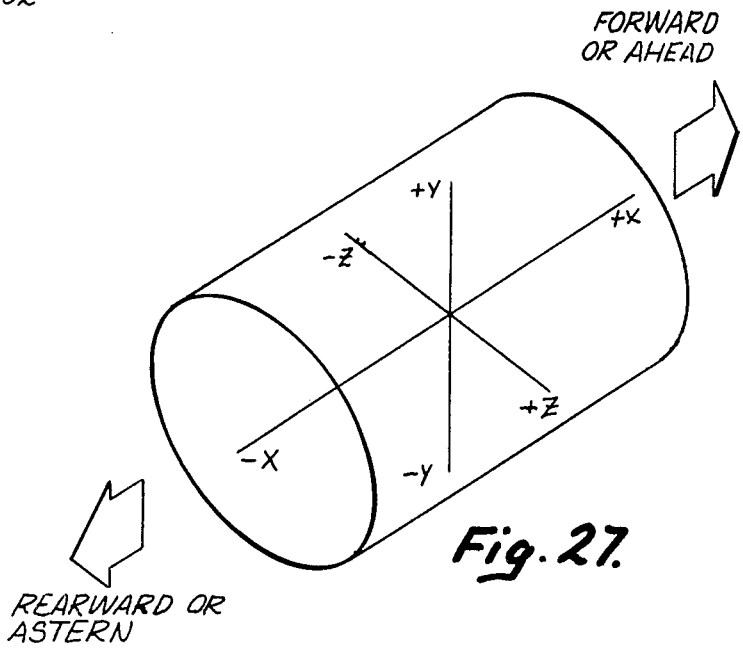
FIG. 27 is a schematic illustration of an accepted coordinate system for describing propeller blade geometry.

In addition, inner blade section 64 has a slightly negative skew (i.e., a blade offset in the positive Z axis direction of the schematic diagram of propeller geometry in FIG. 27) as shown in FIGS. 14 and 15. Based on conventional marine propeller geometry descriptions illustrated in FIG. 27, positioning of the mid-chord line of a propeller blade in the Z axis direction (plus or minus) is referred to as "skew". Blade positioning in a negative Z direction has customarily been called "positive skew" and vice versa. Similarly, conventional blade geometrical description defines rotation of the mid-chord line about the Z axis, i.e., positioning of the blade in the plus or minus X direction, as "geometric rake" or "rake" for purposes of this application. Conventionally, positioning of the blade tip in the aft or negative X direction is called "positive rake" while positioning of the tip in the positive X direction is referred to as "negative rake". Each inner blade section 64 has positive rake. Accordingly, as shown in FIG. 9, the position of mid-chord line 82 (FIG. 9) of the inner blade section 64 in a swept back, inclined manner along the pitch helix with respect to a radial line extending perpendicular to the axis of blade rotation is stated to have positive, nonlinear rake (FIGS. 14 and 15), slightly negative skew at the inner radii, and positive skew at the outer radii.

Figure 31:
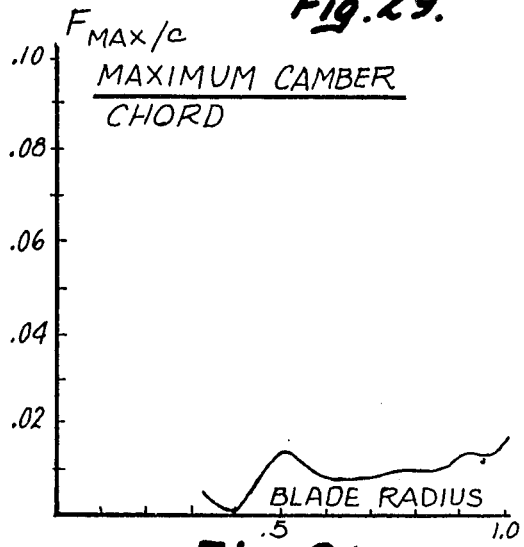
FIG. 31 is a graph of the maximum camber to chord ratio versus blade radius for the propeller blades of FIGS. 7–15.

Referring now to FIGS. 7–9 and 13, the hybrid outer section 66 of each blade includes tapered leading and trailing edges **76*a*, 78*a* respectively. Blade section 66 differs from blade section 28 in propeller 10, however, because at any radial section in the outer portion 66 of the blade, the pressure side and suction side chord lengths are different. Thus, pressure face 70*b* of outer section 66, which is highly concave (cambered) to provide increased lift at high speeds, includes shorter chord lengths ending at a ridge 84 defining the locus of the trailing ends of the pressure side chords. As shown in FIG. 31, the ratio of maximum camber to chord length increases to a maximum at tip 69 while the camber itself is a maximum at a position of approximately 90% of the blade radius. Suction side 72 of outer section 66 is convex and includes chord lengths which are longer than the pressure side chords and end at the trailing edge 78*a*. The thickness of outer section 66 increases toward trailing edge 78*a* and is a maximum at ridge 84 near the trailing edge. In an outward radial direction, the thickness to chord ratio of blade section 66 increases in a direction toward tip 69 as shown in FIG. 30 although the actual thickness decreases in the same direction. Thickness is a minimum at the transition area 74. These different side chord lengths in outer section 66 provide improved subcavitating speed operation. For example, the longer suction side chords provide better low speed or "off design" operation in the non or partially cavitating modes since a greater chord length suppresses cavitation at low speeds for reduced drag and improved efficiency. However, the shorter, more highly cambered pressure side chords of the outer blade section 66** provide improved supercavitating or high speed performance by assuring full development of stable supercavitation at design speed and providing improved ventilation performance and thus better thrust at such high speeds. Thus, the present propeller has improved operation at intermediate speeds and at supercavitating speeds making it more efficient both at the design point or while accelerating as well as during astern operation.

Blade section 66 also differs from blade section 28 by including a trailing surface area 80 which is defined by rectilinear lines joining the trailing chord ends of the pressure and suction side chords at each radial position along the outer section. Hence, the combination of rectilinear, chord end connecting lines forms a contoured surface 80 which provides improved performance. A secondary benefit is improved in reverse or astern operation, i.e., a hub rotation opposite that for forward thrust, because area 80 is inclined to the direction of rotation which provides lift giving thrust in the reverse direction. Trailing surface area 80 also improves supercavitating performance of outer section 66. This trailing surface area is included for improved hydrodynamic reasons although it does add an element of structural strength to the blade.

Figure 8:
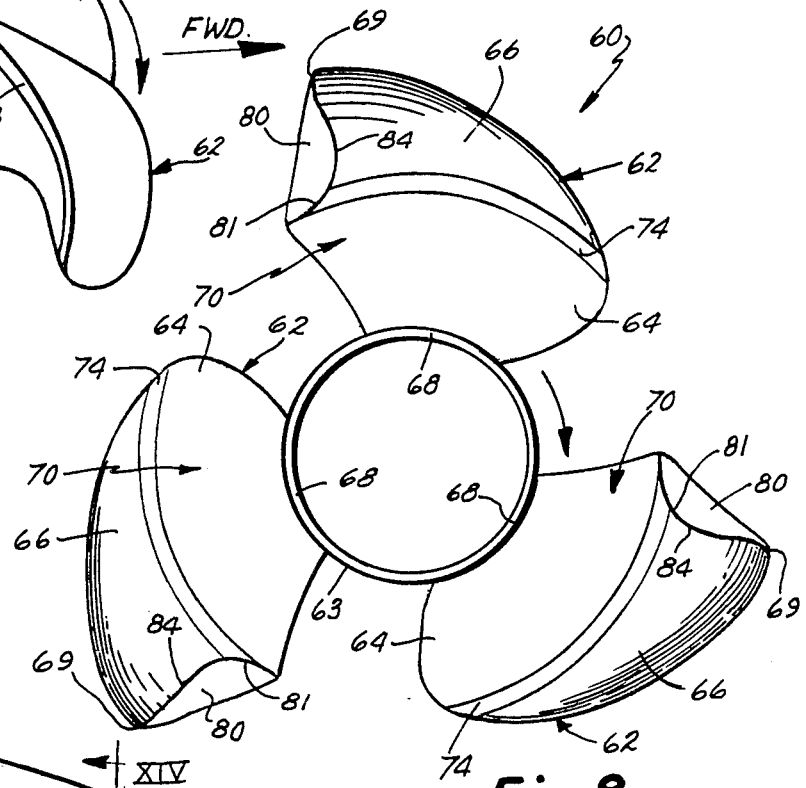
FIG. 8 is a rear elevation of the propeller of FIG. 7 showing the profile of each of the three blades projected parallel to the rotational axis of the propeller hub.
Figure 9:
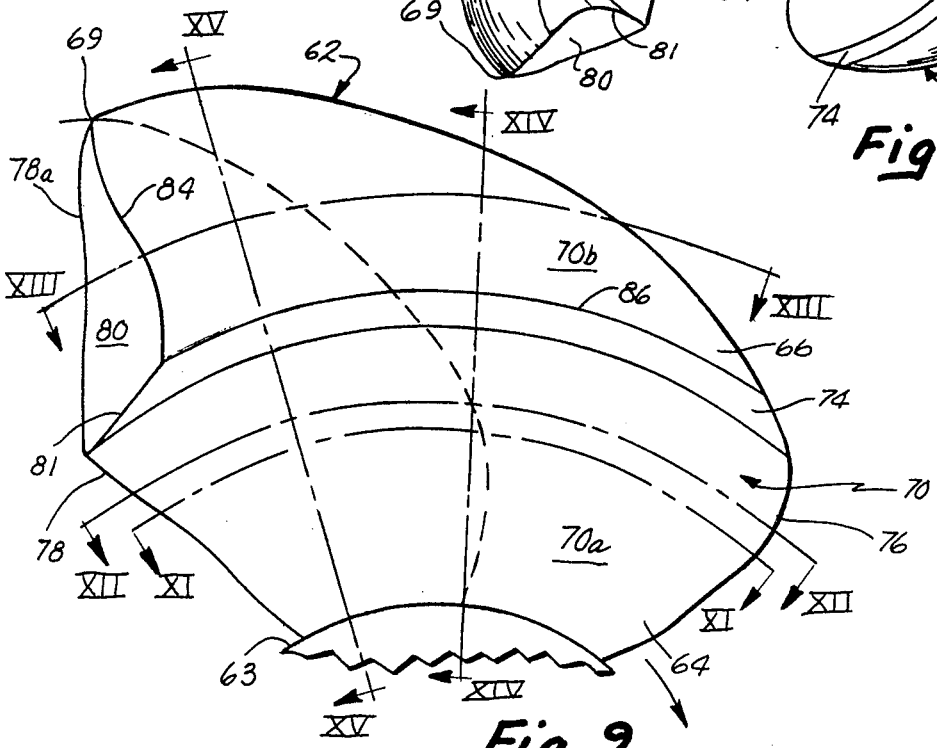
FIG. 9 is an enlarged rear elevation of the pressure face side of one of the blades of the propeller of FIGS. 7 and 8 also showing the profile of the blade projected parallel to the rotational axis of the propeller hub.
Figure 18:
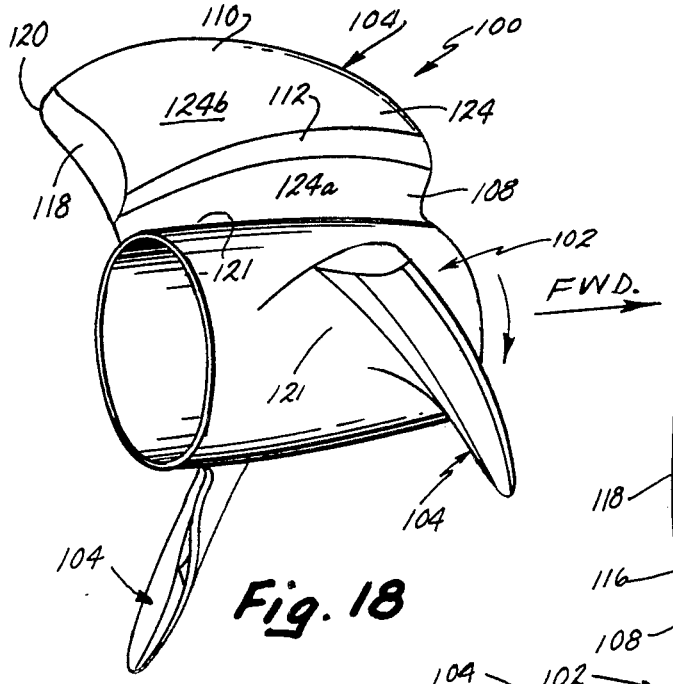
FIG. 18 is a perspective view of a third embodiment of the marine propeller of the present invention comprising a low viscous drag propeller.
Figure 19:
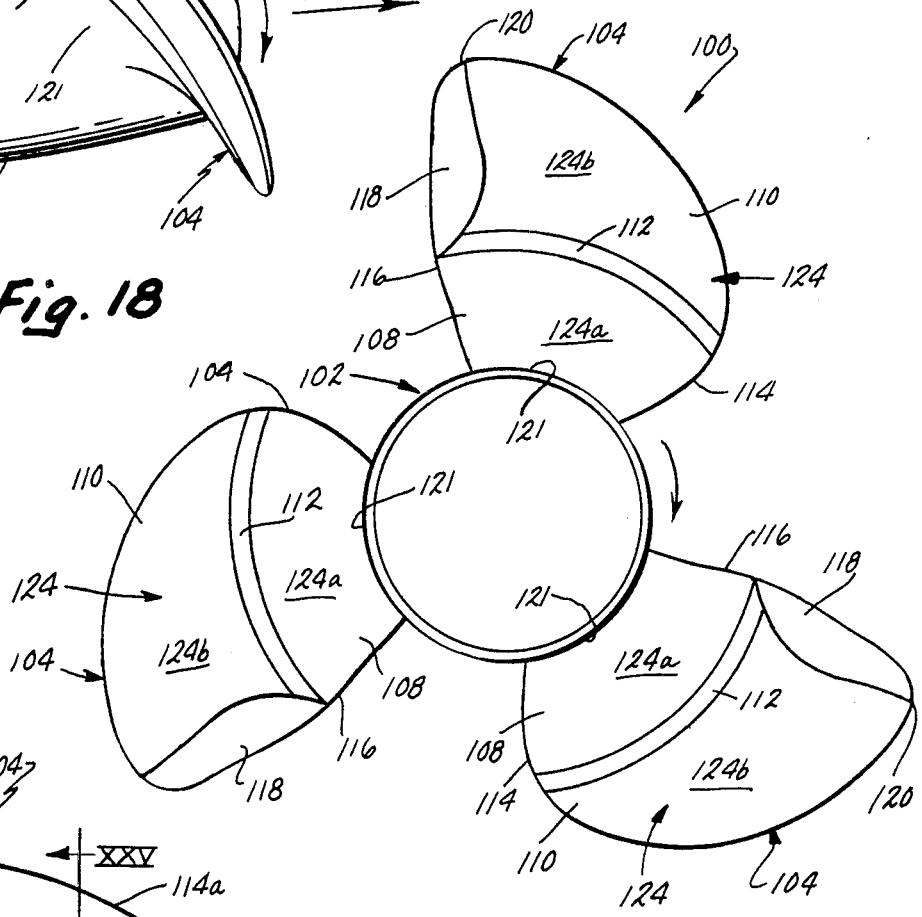
FIG. 19 is a rear elevation of the propeller of FIG. 18 showing the projected profiles of each blade parallel to the rotational axis of the propeller hub.

As shown in FIGS. 8 and 9, the trailing surface area 80 is generally triangular in shape and extends from mid-blade adjacent transition zone 74 to tip 69. Such shape results from the difference in chord lengths between the pressure side and suction side first increasing then decreasing in an outward radial direction. However, the pressure side chords of surface **70*b* progressively decrease in length in an outward radial direction from the outer end of transition zone 74 toward the outer tip. In addition, trailing surface area 80 extends at an inclined angle to the axis of hub rotation and at an acute angle to the suction side 72 and the suction side chords and at an obtuse angle to the pressure side 70*b* and the pressure side chords. Accordingly, when the hub is rotated in the opposite direction trailing surface area 80** provides a pressure side resulting in improved reverse thrust during astern operation.

As shown schematically in FIG. 17, a gas cavity, which is produced at supercavitating speeds by the outer blade section 66, is illustrated trailing downstream and aftward from the trailing edge of blade section 66. The cavity begins at the leading edge **76*a* and encompassing the entire suction side 72 of the blade section. If the blade is near the water surface, the blade will ventilate and the gas cavity will be open to the atmosphere and thus at atmospheric pressure. If the blade is submerged, the blade will not ventilate and the gas cavity will contain water vapor at a predetermined vapor pressure. Supercavitation may thus occur with or without ventilation. In such high speed operation, viscous drag on the back or suction side surface 72 is replaced by pressure drag due to the gas cavity while the higher cambered pressure side having shorter chord lengths for section 66** produces positive pressure or lift L in a direction perpendicular to the in-flow velocity which is parallel to blade pitch. Drag D is produced by the combination of viscous or skin friction drag on the pressure side and pressure drag from the gas cavity.

With reference to FIGS. 7–9, 14 and 15, transition zone 74 extends along pressure side 70 between the inner and outer blade sections 64, 66 and defines an offset between the pressure side surfaces **70*a*, 70*b*. Transition zone 74 minimizes the blade area where partial cavitation occurs and is actually a concave surface (FIGS. 14 and 15) which defines the thinnest portion of the blade and extends upwardly and outwardly from the inner section face or pressure side 70*a* to a relatively sharp ridge 86 between the two areas 70*a*, 70*b* of the pressure side. Ridge 86 and zone 74 extend in an arc generally parallel to the hub circumference from the leading to the trailing edge. The opposite side of blade 62, however, is contoured relatively smoothly from root 68 to tip 69 without any abrupt transition surface offset such as ridge 86 on the pressure side to reduce flow separation and cavitation which causes blade erosion. This reduces or eliminates vortices on the suction side. The transition zone blends into the tapered leading edge 76 at the forward portion of the blade and defines the bottom edge 81 of the trailing surface area 80 at the trailing portion of the blade. Thus, transition zone 74 generally separates the inner and outer sections of blade 62** with an abrupt ridge on the pressure side and allows for differing pitch for the outer section to provide improved performance at high or supercavitating speeds.

Figure 28:
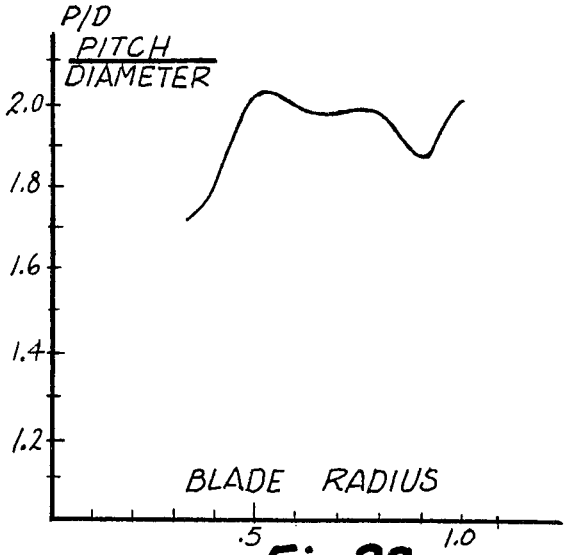
FIG. 28 is a graph of the pitch to diameter ratio versus blade radius for the propeller blades of FIGS. 7–15.
Figure 29:
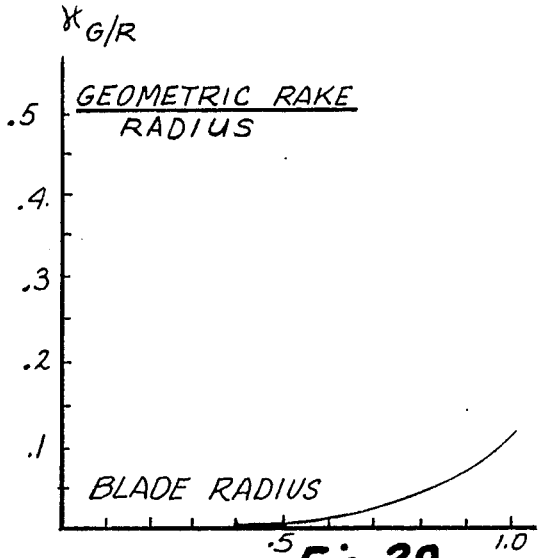
FIG. 29 is a graph of the geometric rake to blade radius ratio versus blade radius for the propeller blades of FIGS. 7–15.

As is shown in FIGS. 9, 10, 14 and 15, outer section 66 has positive, nonlinear rake which is larger in the area of tip 69 and which produces a rearwardly swept back mid-chord line 82. In the preferred embodiment, as shown in FIG. 29, the positive rake progressively increases along in a radial direction toward tip 69. As shown in FIG. 28, the pitch to diameter ratio increases to a peak at relatively low radius and gradually declines to a position near tip 69 where it increases rapidly due to the nonlinear rake in the tip area. Also, the outer section 66 has positive skew (in the negative Z axis direction of FIG. 27) while the inner radii of the blade have slightly negative skew. The result is a generally concave pressure side 70 for the entire blade with the tip area being hooked over in the aft direction. The increased rake at the blade tip helps to shield the tip pressure face from the water surface when the propeller is used on an outboard engine or stern drive which is trimmed toward the water surface to raise the nose of the boat to reduce boat resistance for high speed running. Such increased rake prevents premature ventilation or "blowout" of the blade thereby maintaining proper thrust as the engine and propeller are trimmed. The result allows improved performance through a greater degree of propeller/engine trim at high speed. This feature is different from the blade configuration in propeller 10 wherein the blade tips are hooked forwardly.

Referring now to FIGS. 18–26, a third embodiment 100 of the transcavitating or hybrid propeller of the present invention is illustrated. Propeller 100 is generally similar to propeller 60 and includes the same or essentially similar features except for a different viscous drag emphasis resulting in certain different aspects as explained below. As with propeller 60, propeller 100 includes a hub 102 which may be cylindrical or tapered and three blades 104. The arrows in FIGS. 18–21 illustrate normal hub rotation with blades 104 to produce forward thrust. Each blade 104 includes an inner section 108 contoured to subcavitate at substantially all rotational speeds and an outer section 110 contoured to supercavitate at high rotational speeds. Outer section 110 is separated from inner section 108 by a transition zone 112 extending from the leading edge 114 of blade 104 to the trailing edge 116. A trailing surface area 118 extends along the trailing portion of each blade and is formed by rectilinear lines connecting the trailing ends of the pressure face chords and suction side chords as in propeller 60. Tip 120 has a finite tip chord length as shown in FIGS. 18–21 like blade tips 69 but unlike tips 16 of propeller 10 which extend to a point. Blades 104, however, are low viscous drag blades in which the viscous drag on the inner section is reduced by forming the transition zone 112 closer to the hub and farther from the tip 120 of blade 104 than in blade 62. The cavity drag from outer section 110 at high speeds is somewhat increased with respect to the outer section 66 of propeller 60 since outer section 110 is somewhat larger than outer section 66. Each blade 104 thus appears taller and narrower than blade 62.

As is best seen in FIGS. 20–24, inner blade section 108 has progressively increasing chord lengths in the radially outward direction from root 121 to transition zone 112. Section 108 includes a pressure face surface **124*a* generally facing aft or rearwardly and having a configuration varying from slightly convex to slightly concave along the radius. On the opposite side of blade 104 inner section 108 has a suction side surface 126 which is generally convex and extends smoothly from rounded leading edge 114 to tapered trailing edge 116. For some more highly loaded or thrust producing variations of blade 104, trailing edge 116 of inner section 108 may be truncated as at 117 to maintain higher chord lengths and blade thickness without incurring higher viscous drag. As illustrated in FIG. 16, inner section 108 develops positive lift L and drag D when rotated in the direction of arrows in FIGS. 18–21** to create forward thrust and operates as a subcavitating section at substantially all hub rotational speeds.

Figure 20:
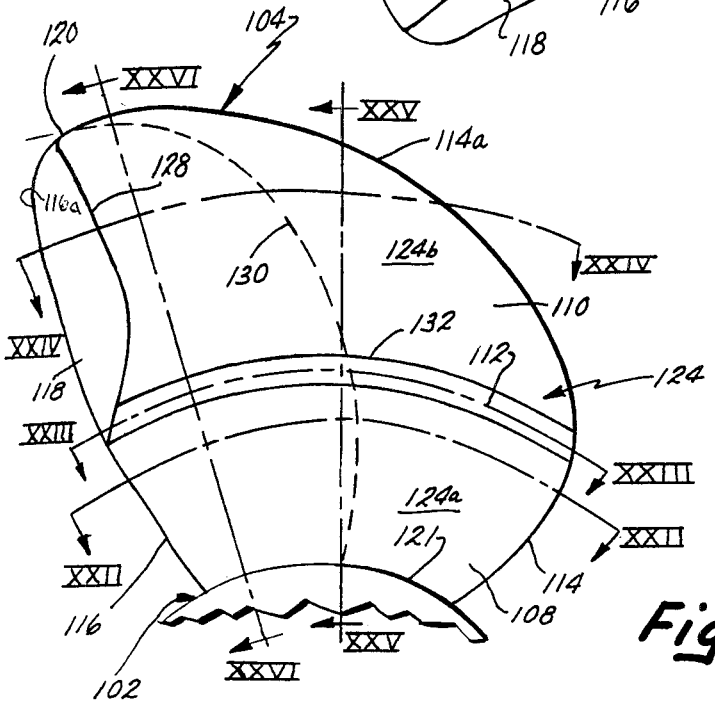
FIG. 20 is an enlarged view of the pressure face side of one of the blades of FIG. 19 projected along the rotational axis of the hub.
Figure 21:
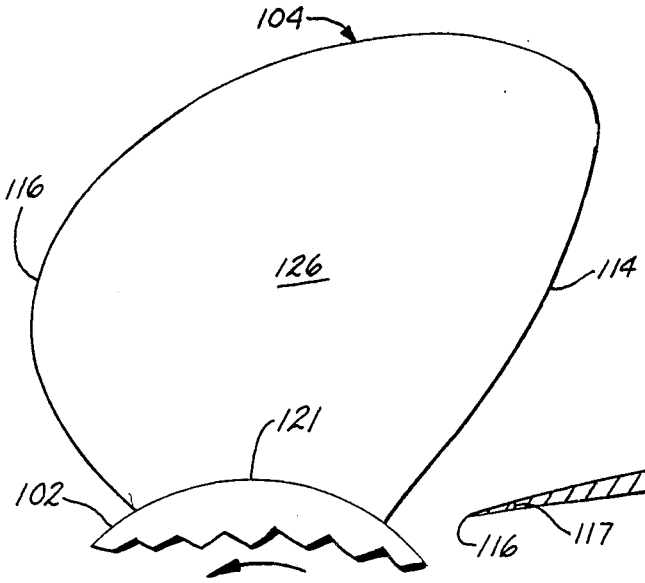
FIG. 21 is an enlarged view of the suction side surface of the blade of FIG. 20 projected along the rotational axis of the hub.
Figure 22:
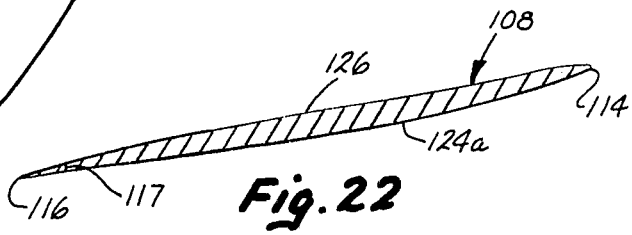
FIG. 22 is a sectional view at approximately 0.375 of the radius of the blade taken along line XXII—XXII of FIG. 20.
Figure 23:
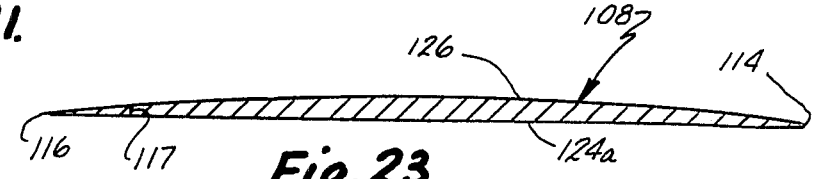
FIG. 23 is a sectional view at approximately 0.50 of the radius of the blade taken along line XXIII—XXIII of FIG. 20.
Figure 24:
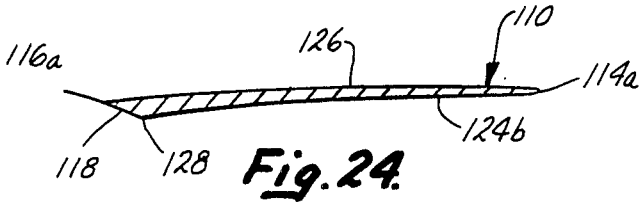
FIG. 24 is a sectional view at approximately 0.875 of the radius of the blade taken along line XXIV—XXIV of FIG. 20.
Figure 35:
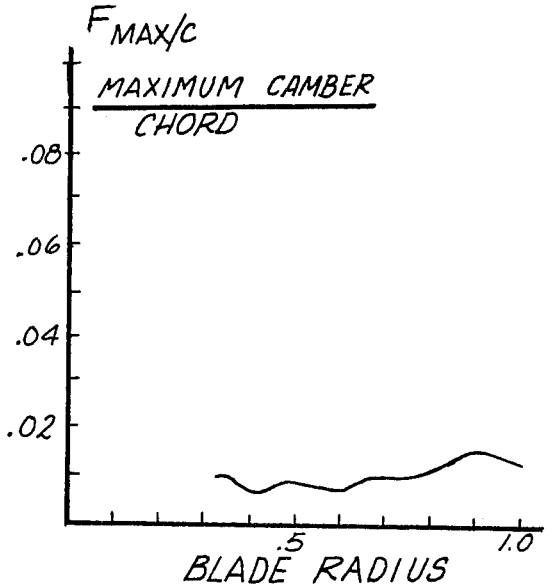
FIG. 35 is a graph of the maximum camber to chord ratio versus blade radius for the propeller blades of FIGS. 18–26.
Figure 36:
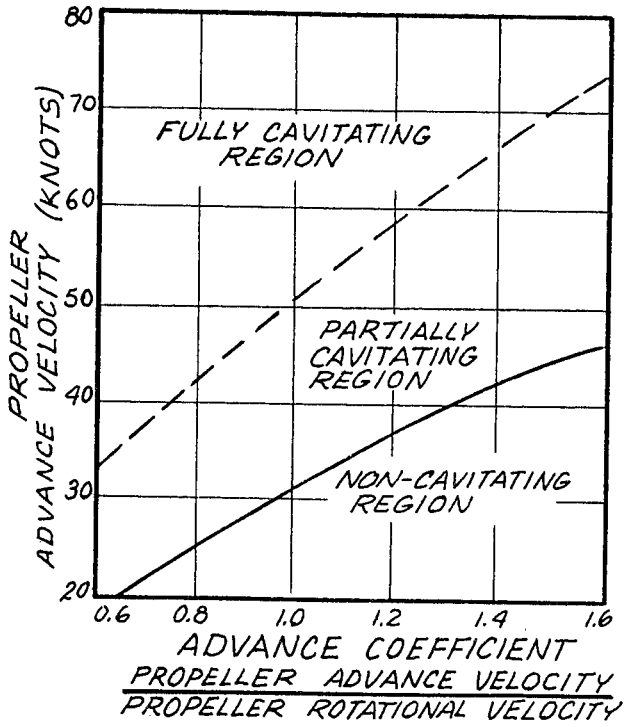
FIG. 36 is a graph of the typical flow regions for marine propellers including propeller advance velocity versus the ratio of propeller advance velocity to propeller rotational velocity, i.e., advance coefficient.

As shown in FIGS. 20, 21 and 24–26, supercavitating outer blade section 110 includes a separate pressure side surface **124*b* which is cambered and concave in shape (FIG. 24) and a convex suction side surface 126 which extends from the inner blade section in a smooth, contoured convex surface without any abrupt transition surface offset. Outer blade section 110 has a tapered leading edge 114*a* and a tapered trailing edge 116*a* (FIGS. 20 and 24). As in propeller 60, the chord lengths of suction side 126 of section 110 are longer than the chord lengths of the highly cambered convex pressure side 124*b* at each radial position. The maximum camber to chord ratio (FIG. 35) increases to a maximum at about 90% of the blade radius which helps improve ventilation performance and thrust of the outer section at high speeds. Triangular, trailing surface area 118 extends from a sharp ridge 128 (FIGS. 20 and 24) along the trailing ends of the pressure side chords to the trailing ends of the suction side chords to provide an angled surface improving astern or reverse performance and, like area 80, is positioned at an inclined angle to the hub rotational axis and at an acute angle to suction side 126 and chords and an obtuse angle to pressure side 124*b* and its chords. The pressure side chords progressively decrease in length from the transition zone 112 toward the tip 120 while the difference in chord lengths first increases then decreases in the same outward radial direction. This provides the trailing surface area 118 with its general triangular shape. The shape of area 118 is, however, slightly more rectangular than the trailing surface area 80 of propeller 60 due to the differing outer section blade geometry for the low viscous drag propeller 100**.

Figure 26:
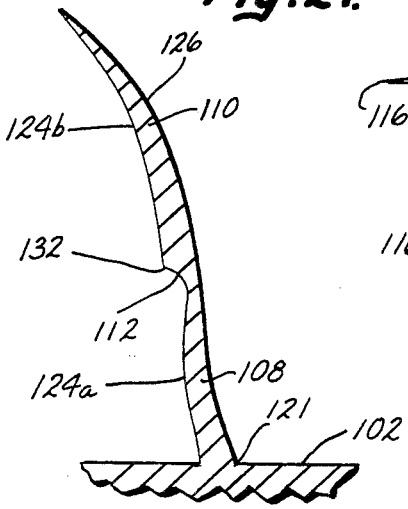
FIG. 26 is a sectional view of the blade taken along a radial line XXVI—XXVI spaced 20 degrees rearwardly from the blade center line or radius XIV—XIV in FIG. 20.
Figure 25:
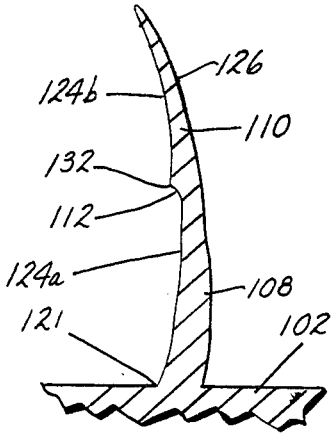
FIG. 25 is a sectional view of the blade taken along the zero degree radius or blade center line XXV—XXV of FIG. 20.
Figure 34:
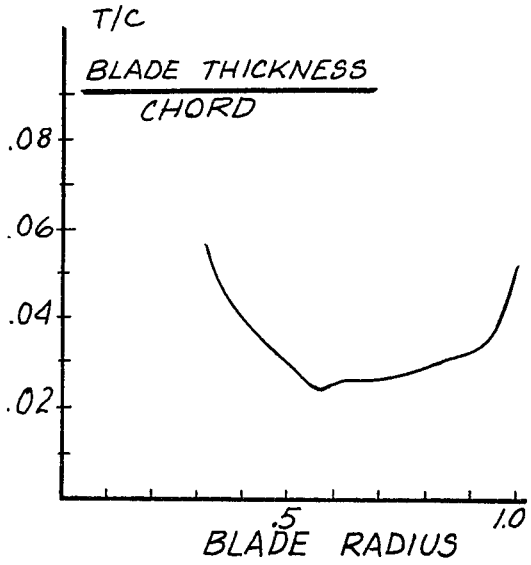
FIG. 34 is a graph of the blade thickness to chord ratio versus blade radius for the propeller blades of FIGS. 18–26.

As shown in FIGS. 20, 25 and 26, transition zone 112 extends in an arc along pressure side 124 generally parallel to the hub circumference from leading edge 114 to trailing edge 116 like transition zone 74 for propeller and defines a portion of the bottom of trailing surface area 118. Transition zone 112 defines the minimum thickness to chord ratio and minimum thickness area of the blade (see FIG. 34), and extends upwardly and outwardly to define a sharp ridge 32 forming an abrupt end to the pressure side surface **124*b* of outer section 110. Transition zone 112 thus providing an offset of pressure side surface 124*b* from the pressure side surface 124*a* of inner section 108**.

Figure 32:
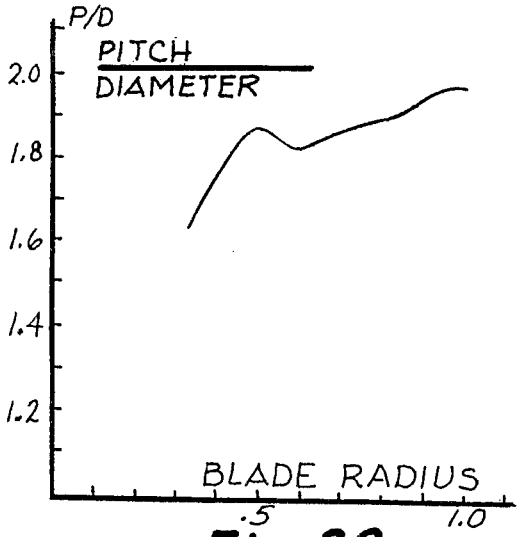
FIG. 32 is a graph of the pitch to diameter ratio versus blade radius for the propeller blades of FIGS. 18–26.
Figure 33:
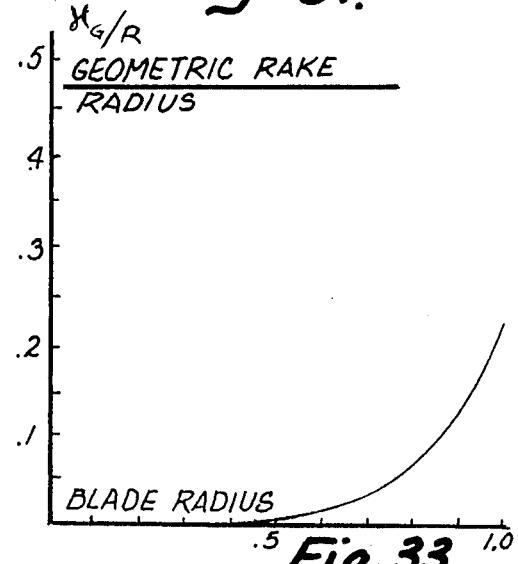
FIG. 33 is a graph of the geometric rake to blade radius ratio versus blade radius for the propeller blades of FIGS. 18–26.

As is also apparent from FIGS. 20, 25 and 26, midchord line 130 extends rearwardly in swept back fashion from the center blade radius to provide each blade 104 with positive rake, slightly negative skew at the inner radii, and positive skew in outer section 110. As with blades 62, the rake is nonlinear and increases toward the tip at an even greater rate than the increasing rake in the outer section 66 of blade 62 (see FIGS. 29 and 33). Blades 104 thus have a generally concave pressure side 124 like that of blades 62 with the area of tip 120 hooked over in the aft direction to help ventilation performance. As shown in FIG. 32, the pitch to diameter ratio of blades 104 increases from root to tip although that ratio slightly decreases in the tip region because of high tip sweep and short outer section chord lengths. The result is reduced intermediate blade loading in blades 104 which maintains cavitation free flow below transition zone 112 while maintaining moderate intermediate chord distribution and reduced intermediate blade viscous drag.

Each of the composite hybrid blades 62 of FIGS. 7–15 including inner and outer sections 64, 66 is a low cavity drag blade in which slightly more viscous drag on the suction pressure sides of the inner blade section 66 is tolerated while pressure drag due to the gas cavity trailing behind the outer blade section 66 (FIG. 17) at higher speeds is reduced. Thus, in propeller 60, transition zone 74 is spaced relatively farther from hub 63 than is transition zone 112 in propeller 100 thereby providing a larger blade area ratio for inner section 64 in propeller 60 than for outer section 66 as compared to the inner and outer sections 108, 110 of propeller 100. In addition, the overall diameter of the blades 62 of propeller 60 is smaller than for blades 104 of propeller 100 while the chord lengths are generally longer for blades 62 such that the blade area ratio is increased. Further, the pitch of blade 62 at the tip sections is less than blade 104.

Like propeller 60, propeller 100 provides improved design point operation at high speeds with inner section 108 continuing to subcavitate as shown in FIG. 16 with outer section 110 supercavitating in the manner shown in FIG. 17. As with propeller 60, performance at subdesign point speeds is also improved due to the longer suction side chords of suction surface 126 in the outer section. Overall, propeller 100 has generally shorter chords and lower viscous drag than propeller 60, although cavitation drag on outer section 110 is somewhat higher since transition zone 112 is positioned at approximately 0.575 of the total radius of the blade, i.e., closer to the hub than in propeller 60. Propeller 100 also provides increased loading at the tips 120 although the overall efficiencies of propellers 60 and 100 is substantially similar.

It is possible to smooth and fair the transition zone ridges 86, 132 on propellers 60, 100 thereby providing a different section shape over only about 10% of the blade radius. This maintains substantially the same performance for the propellers.

Accordingly, the improved, transcavitating propellers of the present invention provide improved performance at both high design point speeds and off design speeds during acceleration and astern or reverse operation, while preventing premature ventilation or blowout allowing improved trim toward the water surface during high speed propeller operation.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiment of the invention in which an exclusive property or privilege is claimed are defined as follows:

1. A marine propeller having a hub and a plurality of blades attached to the hub, said blades each comprising a body having a radially inner end connected to said hub and a radially outer tip located radially outwardly from said inner end, said blade body having an inner section adjacent said inner end with means for causing said inner section to subcavitate at substantially all rotational speeds and an outer section adjacent said tip, said outer section having a tapered leading edge portion and a tapered trailing edge portion with means for causing said outer section to subcavitate at slow speeds and supercavitate at high rotational speeds.

2. The propeller according to claim 1 wherein said subcavitating inner section is configured so that in a direction from said inner end toward said tip said inner section is of a progressively increasing chord length to a region intermediate said inner end and said tip, said outer section having a progressively decreasing chord length in a direction toward said tip.

3. The propeller according to claim 2 wherein said tip terminates in a point and said blade is proportioned so that the mid-chord line for said blade extending through said point extends rearwardly and radially outwardly through said outer section at an angle inclined with respect to a radial line through said blade.

4. The propeller according to claim 2 wherein said blade body has a generally convex suction side and a generally concave pressure side, said supercavitating section being of generally greater concavity than said subcavitating inner section

5. The propeller according to claim 4 wherein said sides of said body are smoothly curved and contoured so as to avoid sharp surface irregularities.

6. A marine propeller having a hub and a plurality of blades each attached to the hub, said blades each comprising a body having a radially inner end connected to said hub and a radially outer tip located radially outwardly from said inner end;

said body having an inner section located adjacent said inner end and extending outwardly therefrom which is contoured so that it has a rounded leading edge and a tapered trailing edge portion with arcuate pressure and suction side surfaces extending therebetween;

said body having an outer section located adjacent said tip and extending radially inwardly therefrom which is contoured so that it has tapered trailing and leading edge extending therebetween, said side surfaces of said outer body section being of higher pitch than said inner section so as to give said outer section a higher angle of attack than said inner section, means whereby during rotation of said blade at slow speeds both sections function in a noncavitation producing manner and at high speeds said inner section continues to subcavitate and said outer section functions as a supercavitation section.

7. A propeller according to claim 6 wherein said tip terminates in a point and said blade is proportioned so that the mid-chord line for said blade extending through said point extends rearwardly and radially outwardly through said outer section at an angle inclined with respect to a radial line through said blade, so that radial flow is induced which promotes minimum radial extent of transition from sub-to-supercavitating flow.

8. A propeller according to claim 7 wherein said subcavitating inner section is configured so that in a direction from said inner end toward said tip said inner section is of a progressively increasing chord length to a region intermediate said inner end and said tip, said outer section having progressively decreasing chord length in a direction toward said tip.

9. A marine propeller having a hub and a plurality of blades each attached to the hub, said blades each comprising a body having a radially inner end connected to said hub and a radially outer tip having an inner section located radially outwardly from said inner end, said blade body having an inner section adjacent said inner end with means for causing said inner section to subcavitate at substantially all rotational speeds and an outer section adjacent said tip with means for causing said outer section to supercavitate and create a cavity at high rotational speeds, said blade proportioned so that the mid-chord line for said blade extending through said tip and hub extends rearwardly and radially outwardly through said outer section at a swept back angle inclined with respect to a radial line extending perpendicular to the axis of rotation of said blade through said blade whereby radially outer flow of the liquid medium in which the propeller operates is induced to deflect the cavity on the blade outwardly away from the subcaviating inner end.

10. A marine propeller having a hub and a plurality of blades, each of said blades comprising a body having a radially outer end located radially outwardly from said inner end;

said body having an inner section located adjacent said inner end and extending outwardly therefrom which is contoured so that it has a rounded leading edge and a tapered trailing edge portion with arcuate pressure and suction side surfaces extending therebetween and shaped to function as a subcavitating section;

said body also having an outer section located adjacent said tip and extending radially inwardly therefrom which is contoured so that it has a tapered leading edge portion and a trailing edge portion, said leading and trailing edge portions having arcuate pressure and suction side surfaces extending therebetween, said side surfaces of said outer body section being of higher pitch than said inner section so as to give said outer section a higher angle of attack than said inner section whereby said outer section functions as a supercavitating section to create a cavity on the suction side at high speeds; and said blade being proportioned so that the mid-chord line for said blade extending through said tip and hub extends rearwardly and radially outwardly through said outer section at an angle inclined with respect to a radial line through said blade thereby sweeping the blade tip back along the pitch helix and inducing radially outward flow components over the tip which assist in the deflection of the cavity on the suction side outwardly away from the subcavitating inner section.

11. A marine propeller having a hub and a plurality of blades each attached to said hub, said blades each comprising:

a body having a radially inner end connected to said hub, a radially outer tip, an inner section adjacent said inner end, and an outer section adjacent said tip;

said inner section having contoured suction and pressure sides on opposite sides of said blade which cause said inner section to subcavitate at substantially all rotational speeds;

said outer section being contoured to supercavitate at high rotational speeds and including a convex suction side and a concave pressure side on opposite sides of said blade, said suction side having a chord length greater than the chord length of said pressure side generally at each radial position along said outer section, and a trailing surface area which extends between the trailing ends of the chords on said pressure side and the trailing ends of the chords on said suction side.

12. The marine propeller of claim 11 wherein said trailing surface area is formed by rectilinear lines connecting said trailing chord ends at each radial position along said outer section and extends at an inclined angle to both the suction and pressure sides and their chords and to the axis of rotation of said hub.

13. The marine propeller of claim 12 wherein said trailing surface area is generally triangular in shape; said chords on said outer section pressure side progressively decreasing in length over the radial extent of said outer section toward said outer tip.

14. The marine propeller of claim 13 wherein the difference in said pressure side and suction side chord lengths on said outer section progressively increase and then decrease in a radially outward direction.

15. The marine propeller of claim 11 including a transition zone extending between said inner and outer blade sections, said transition zone being formed by an offset in the pressure side surface of said outer section with respect to the pressure side surface of said inner section, said suction side being contoured to extend smoothly from said inner to said outer section.

16. The marine propeller of claim 15 wherein said transition zone extends in an arc between the leading edge of said pressure side and said trailing surface area, said transition zone also having a concave curvature extending from the pressure side surface of said inner section to a sharp ridge extending along said pressure side also generally in an arc between said leading edge and said trailing surface area, said ridge defining the inner end of said pressure side surface of said outer section.

17. The marine propeller of claim 15 wherein said blade is proportioned so that the mid-chord line for said blade extending through said tip and hub extends rearwardly and radially outwardly through said outer section at a swept back angle inclined with respect to a radial line extending perpendicular to the axis of rotation of said blade through said blade.

18. The marine propeller of claim 17 wherein said mid-chord line is inclined rearwardly with respect to said radial line at an increasing rate progressively toward said outer tip.

19. The marine propeller of claim 18 wherein each blade of said propeller has positive rake; the inner section of said blade having slightly negative skew; the outer section of said blade having positive skew.

20. The marine propeller of claim 11 wherein said outer section includes a tapered leading edge and a tapered trailing edge.

21. The marine propeller of claim 20 wherein said inner section includes a rounded leading edge and a tapered trailing edge.

22. The marine propeller of claim 21 wherein said inner section is configured to include a convex suction side and a convex pressure side.

23. The marine propeller of claim 21 wherein said inner section is configured to include a convex suction side and a pressure side which varies from convex to concave along a radius of said blade.

24. The marine propeller of claim 20 wherein said inner section includes a rounded leading edge and a truncated trailing edge.

25. The marine propeller of claim 11 wherein said blade is proportioned so that the mid-chord line for said blade extending through said tip and hub extends rearwardly and radially outwardly through said outer section at a swept back angle and is inclined with respect to a radial line extending perpendicular to the axis of rotation of said blade through said blade whereby radially outer flow of the liquid medium is induced to deflect the supercavity on the blade outwardly away from the subcavitating inner end.

26. A marine propeller having a hub and a plurality of blades each attached to said hub, said blades each comprising:

a body having a radially inner end connected to said hub, a radially outer tip, an inner section adjacent said inner end, and an outer section adjacent said tip;

said inner section having contoured suction and pressure side on opposite sides of said blade which cause said inner section to subcavitate at substantially all rotational speeds;

said outer section having contoured suction and pressure sides on opposite sides of said blade which cause said outer section to supercavitate at high rotational speeds;

said blade being proportioned so that said blade has positive rake.

27. The marine propeller of claim 26 wherein said positive rake increases progressively in a direction toward said outer tip.

28. The marine propeller of claim 27 wherein said blade has positive skew in said outer section.

29. The marine propeller of claim 28 wherein said blade has negative skew in said inner section.

30. The marine propeller of claim 26 wherein said blade has positive skew in said outer section.

31. The marine propeller of claim 26 wherein said outer section includes a convex suction side and a concave pressure side on opposite sides of said blade, said suction side having a chord length greater than the chord length of said pressure side generally at each radial position along said outer section, and a trailing surface area which extends between the trailing ends of the chords on said pressure side and the trailing ends of the chords on said suction side.

32. The marine propeller of claim 31 wherein said trailing surface area is formed by rectilinear lines connecting said trailing chord ends at each radial position along said outer section and extends at an inclined angle to the axis of rotation of said hub and to both the suction and pressure sides and their chords.

33. The marine propeller of claim 32 wherein said trailing surface area is generally triangular in shape; said chords on said outer section pressure side progressively decreasing in length over the radial extent of said outer section toward said outer tip.

34. The marine propeller of claim 33 wherein the difference in said pressure and suction side chord lengths on said outer section progressively increase then decrease in a radially outward direction.

35. The marine propeller of claim 26 including a transition zone extending between said inner and outer blade sections, said transition zone being formed by an offset in the pressure side surface of said outer section with respect to the pressure side surface of said inner section, said suction side being contoured to extend smoothly from said inner to said outer section.

36. The marine propeller of claim 35 wherein said transition zone extends in an arc between the leading edge of said pressure side and said trailing surface area, said transition zone also having a concave curvature extending from the pressure side surface of said inner section to a sharp ridge extending along said pressure side also generally in an arc between said leading edge and said trailing surface area, said ridge defining the inner end of said pressure side surface of said outer section.

37. The marine propeller of claim 26 wherein said outer section includes a tapered leading edge and a tapered trailing edge.

38. The marine propeller of claim 37 wherein said inner section includes a rounded leading edge and a tapered trailing edge.

39. The marine propeller of claim 37 wherein said inner section includes a rounded leading edge and a truncated trailing edge.

40. The marine propeller of claim 37 wherein said inner section is configured to include a convex suction side and a convex pressure side.

41. A marine propeller having a hub and a plurality of blades each attached to said hub, said blades each comprising:

a body having a radially inner end connected to said hub, a radially outer tip, an inner section adjacent said inner end, and an outer section adjacent said tip;

said inner section having contoured suction and pressure side on opposite sides of said blade which cause said inner section to subcavitate at substantially all rotational speeds;

said outer section having contoured suction and pressure side on opposite sides of said blade which cause said outer section to supercavitate at high rotational speeds;

said blade being proportioned so that said blade has positive skew in said outer section.

42. The marine propeller of claim 41 wherein said blade has negative skew in said inner section.

43. The marine propeller of claim 41 wherein said blade has positive rake.

44. The marine propeller of claim 43 wherein said positive rake increases progressively in a direction toward said outer tip.

* * * * *

UNITED STATES PATENT AND TRADEMARK OFFICE

CERTIFICATE OF CORRECTION

PATENT NO. : 4,789,306

DATED : December 6, 1988

INVENTOR(S) : William S. Vorus and Robert F. Kress

It is certified that error appears in the above-identified patent and that said Letters Patent is hereby corrected as shown below:

Column 7, lines 19 and 20:

"suction face 3" should be --suction face 34--.

Column 12, line 11:

After "propeller" insert --60--.

Column 12, line 18:

"providing" should be --provides--.

Column 13, claim 4, line 56:

After "supercavitating" insert --outer--.

Column 17, claim 34, lines 25 and 26:

"increase then decrease" should be --increases then decreases--.

Column 18, claim 41, line 24:

"side" should be --sides--.

UNITED STATES PATENT AND TRADEMARK OFFICE

CERTIFICATE OF CORRECTION

PATENT NO. : 4,789,306

DATED : December 6, 1988

INVENTOR(S) : William S. Vorus and Robert F. Kress

It is certified that error appears in the above-identified patent and that said Letters Patent is hereby corrected as shown below:

Column 18, claim 41, line 28:

"side" should be --sides--.

Signed and Sealed this

Twelfth Day of September, 1989

*Attest:*

*Attesting Officer*

DONALD J. QUIGG

*Commissioner of Patents and Trademarks*